US010410803B2

(12) United States Patent
Wu

(10) Patent No.: US 10,410,803 B2
(45) Date of Patent: Sep. 10, 2019

(54) SILENT KEY SWITCH

(71) Applicant: DONGGUAN CITY KAIHUA ELECTRONICS CO., LTD, Dongguan, Guangdong (CN)

(72) Inventor: Fuxi Wu, Guangdong (CN)

(73) Assignee: DONGGUAN CITY KAIHUA ELECTRONICS CO., LTD., Dongguan, Guangdong (CN)

( * ) Notice: Subject to any disclaimer, the term of this patent is extended or adjusted under 35 U.S.C. 154(b) by 0 days.

(21) Appl. No.: 15/959,725

(22) Filed: Apr. 23, 2018

(65) Prior Publication Data

US 2018/0240618 A1 Aug. 23, 2018

Related U.S. Application Data

(63) Continuation of application No. PCT/CN2016/101534, filed on Oct. 9, 2016.

(30) Foreign Application Priority Data

Oct. 23, 2015 (CN) ..... 2015 2 0824347 U

(51) Int. Cl.
*H01H 13/12* (2006.01)
*H01H 13/10* (2006.01)
(Continued)

(52) U.S. Cl.
CPC ..... *H01H 13/12* (2013.01); *H01H 13/10* (2013.01); *H01H 3/125* (2013.01); *H01H 13/20* (2013.01);
(Continued)

(58) Field of Classification Search
CPC ..... H01H 13/12; H01H 13/10; H01H 13/79; H01H 13/20; H01H 3/125;
(Continued)

(56) References Cited

U.S. PATENT DOCUMENTS 8,431,852 B2 4/2013 Maruyama et al.
9,362,062 B1 * 6/2016 Wu ..... H01H 3/125
(Continued)

FOREIGN PATENT DOCUMENTS

CN 2569226 8/2003
CN 104409259 3/2015
(Continued)

OTHER PUBLICATIONS

Written Opinion and International Search Report for International application No. PCT/CN2016/101534, dated Dec. 28, 2016; 10 pages (English and Chinese).

*Primary Examiner* — Edwin A. Leon
*Assistant Examiner* — Lheiren Mae A Caroc
(74) *Attorney, Agent, or Firm* — Rankin, Hill & Clark LLP

(57) ABSTRACT

A silent key switch includes a base body, a static contact, a dynamic contact, a movable plate, a first balancing stand, a second balancing stand, and a keycap. The movable plate includes a silencer body arranged on the head of the movable plate, a U-shaped groove provided on the rear part of the movable plate, and a first slot provided adjacent to the silencer body; one end of the movable plate where the silencer body is located is abutted against the dynamic contact and the static contact; the first balancing stand and the second balancing stand intersect with each other and are pin jointed together in a superimposed way.

7 Claims, 7 Drawing Sheets

(51) Int. Cl.
*H01H 3/12* (2006.01)
*H01H 13/20* (2006.01)
*H01H 13/79* (2006.01)

(52) U.S. Cl.
CPC ..... *H01H 13/79* (2013.01); *H01H 2217/004* (2013.01); *H01H 2221/062* (2013.01); *H01H 2227/036* (2013.01)

(58) Field of Classification Search
CPC ..... H01H 2221/062; H01H 2217/004; H01H 2227/036; H01H 13/84; H01H 13/85; H01H 13/7065
USPC ..... 200/5 A, 341, 344
See application file for complete search history.

(56) References Cited

U.S. PATENT DOCUMENTS

2017/0062152 A1* 3/2017 Wu ..... H01H 13/285
2018/0226211 A1* 8/2018 Wu ..... H01H 13/7065

FOREIGN PATENT DOCUMENTS

CN 2055508686 8/2016
JP 2006190552 7/2006

* cited by examiner

SILENT KEY SWITCH

This application is a continuation of Ser. No. PCT/CN2016/101534 filed on Oct. 9, 2016, which is expressly incorporated herein by reference.

FIELD OF THE INVENTION

The present application relates to the felid of key switches, especially to a silent key switch.

BACKGROUND OF THE INVENTION

A key switch, as the name suggests, is a switch applied to and installed on a key, which key switch mainly includes a base body, an upper cover, a static contact, a dynamic contact and a key; the upper cover and the base body are arranged in a way such that a holding cavity is formed; the static contact, the dynamic contact and the key are arranged in the holding cavity, one end of the key protruding beyond the holding cavity. The key moves upwards and downwards upon press, such that force acts on the dynamic contact through the key to connect or disconnect the dynamic contact with (from) the static contact, turning on and off the keyboard.

Although the market-available key switch may achieve the effect mentioned above, which is progressive, it still has some disadvantages in structure and performance, which makes it impossible to achieves desirable using performance and working efficiency. Disadvantages can be concluded as follows:

Buttons of the market-available key switches are normally guide rods. On one hand, a key switch using the guide rod is thick; on the other hand, since the buttons are mounted in the center of the bottom of the upper cover, when a finger works on an edge of one side of the upper cover, the buttons cannot be pressed down firmly; therefore, the static contact and the dynamic contact cannot be connected; thirdly, noise will be made while the static contact and the dynamic contact are connected, which is undesirable for some occasions in which quietness is required, and may bring trouble for people's work and life.

SUMMARY OF THE INVENTION

In order to deal with the above issue, the present application provides a silent key switch with simple and ingenious structure, firm press-down effect, low noise, and thinness of the overall structure.

The silent key switch includes a base body, a static contact, a dynamic contact, a movable plate, a first balancing stand, a second balancing stand, and a keycap; the static contact and the dynamic contact are separately arranged on the base body, in which the static contact includes a first welding leg and a static contact point, and the dynamic contact includes a second welding leg and a dynamic contact point; both the second welding leg and the first welding leg protrude beyond the base body; the movable plate includes a silencer body arranged on a head of the movable plate, a U-shaped groove provided on a rear part of the movable plate, and a first slot provided adjacent to the silencer body; an end of the movable plate where the silencer body is located is abutted against the dynamic contact and the static contact; the first balancing stand and the second balancing stand intersect with each other and are pin jointed together in a superimposed way; a lower end of the first balancing stand and a lower end of the second balancing stand are pin jointed with the two ends of the base body respectively; an upper end of the first balancing stand and an upper end of the second balancing stand are pin jointed with the two ends of the bottom of the keycap respectively. An X-shaped structure is formed by the first balancing stand and the second balancing stand; the movable plate, the dynamic contact, and the static contact are all located between the cross superimposed parts of the first balancing stand and the second balancing stand; and an elastic body is arranged between the first balancing stand and the U-shaped groove of the movable plate; the silencer body is a soft rubber and the elastic body is a tension spring.

Further to the embodiment above, both the first balancing stand and the second balancing stand are of U shape, in which the first balancing stand includes a first cross bar and two first connecting rods. Two ends of the first cross bar protrude outwards to form a first pin jointed shaft which is pin jointed with the keycap. The two first connecting rods are parallel to each other and respectively connected with each of two ends of the first cross bar. Inner sides of rear ends of the two first connecting rods both protrude to form a second pin jointed shaft which is pin jointed with the base body. The second balancing stand includes a second cross bar and two second connecting rods. Two ends of the second cross bar protrude outwards to form a third pin jointed shaft which is pin jointed with the keycap. The two second connecting rods are parallel to each other and respectively connected with each of two ends of the second cross bar. Inner sides of rear ends of the two second connecting rods both protrude to form a fourth pin jointed shaft which is pin jointed with the base body. Furthermore, the two second connecting rods are respectively arranged along inner sides of the two first connecting rods, while middle parts of the two second connecting rods are respectively pin jointed with middle parts of the two first connecting rods; a second slot is provided in one side of the first cross bar facing the second cross bar; a bulge is provided on one side of the second cross bar facing the first cross bar, in which the second slot is corresponded to the bulge. Two ends of the elastic body are respectively hooked up to the first slot of the movable plate and the second slot of the first balancing stand so as to move the movable plate.

Further to the embodiment above, a first inlay slot is arranged in a rear end of the second connecting bar; while a second inlay slot is arranged in an inner side of a front end of the second connecting bar. Under superimposed state, a front half section of the first connecting bar is inlayed in the first inlay slot, while the rear half section of the first connecting bar is inlayed in the second inlay slot.

Further to the embodiment above, an external side of a middle section of the first connecting bar protrudes outwards to form a fifth pin jointed shaft; correspondingly, the second pin jointed shaft is provided with a pin jointed hole. The fifth pin jointed shaft is inserted into the pin jointed hole for pin joint.

Further to the embodiment above, a first pin jointed slot and a second pin jointed slot are arranged in the base body. The second pin jointed shaft and the fourth pin jointed shaft are respectively inlayed in the first pin jointed slot and the second pin jointed slot.

Further to the embodiment above, a button hole is arranged in the keycap; while a button tooth corresponding to the button hole is arranged on the base body. The button hole together with the button tooth may make the keycap fitted to the base body detachably.

Further to the embodiment above, the first balancing stand and the second balancing stand are arranged around a periphery of the base body.

Advantages of the present application include:

Firstly, the silencer body is arranged on a head of the movable plate; therefore, when the movable plate moves upwards and downwards, the first balancing stand and the second balancing stand would be impacted through the silencer body that acts as a buffer, which lower the noise while pressing the switch with simple and ingenious structure. Secondly, whichever position of the keycap is under force of a finger, the first balancing stand and the second balancing stand are always working in linkage such as to move the movable plate, realizing firm downwards press and making the connection between the static contact and the dynamic contact more sensitive; furthermore, no noise will be generated while the connection occurs, further reducing working noise while the key switch is working. Thirdly, by intersecting the first balancing stand with the second balancing stand and pin jointing the first balancing stand with the second balancing stand in a superimposed way, and forming the X-shaped structure using the first balancing stand and the second balancing stand so as to move the movable plate through the elastic body, the thickness of the product is reduced substantially compared with traditional guide-rod structure, which is advantageous for miniaturization. Fourthly, the silencer body is a soft rubber which acts as a buffer against impact with excellent silencing effect, which further lowers the noise while the key switch is working and avoid bringing trouble to people's work and life, such that the key switch of the present application is very applicable for occasions in which quietness is required.

DETAILED DESCRIPTION OF THE PREFERRED EMBODIMENT

Technical solutions in the embodiments of the present application will be described hereinafter with reference to the accompanying drawings.

Figure 1:
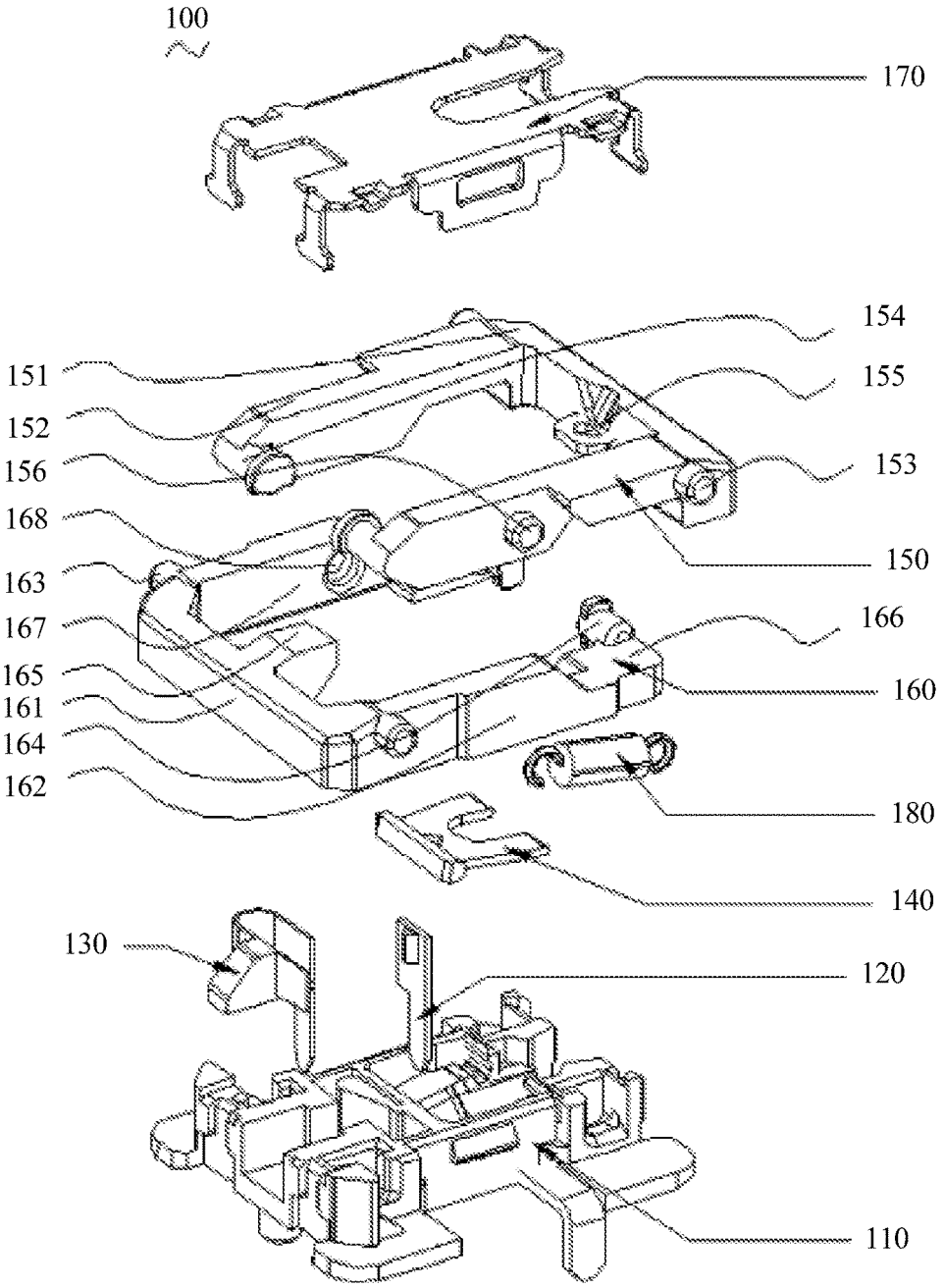
FIG. 1 show an exploded view of the silent key switch according to one embodiment of the present application.
Figure 2:
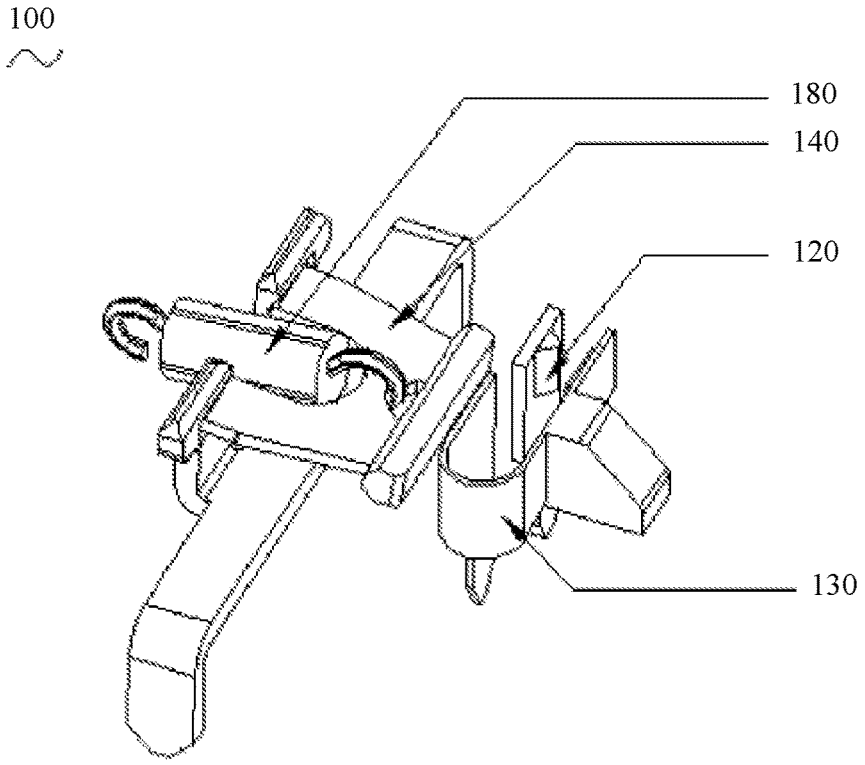
FIG. 2 show a partial assembly view of the silent key switch according to one embodiment of the present application.

FIG. 1 and FIG. 2 are respectively exploded and partial assembly views of the silent key switch of the present application. The silent key switch 100 includes a base body 110, a static contact 120, a dynamic contact 130, a movable plate 140, a first balancing stand 150, a second balancing stand 160, and a keycap 170; the static contact 120 and the dynamic contact 130 are separately arranged on the base body 110; the first balancing stand 150 and the second balancing stand 160 are arranged around a periphery of the base body 110.

Figure 3:
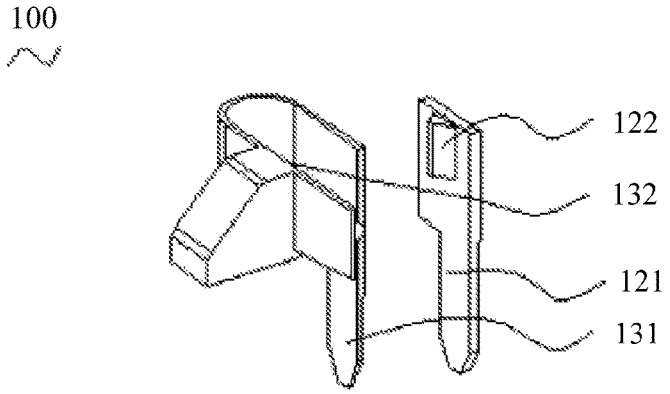
FIG. 3 shows a structural view of the dynamic contact and the static contact according to one embodiment of the present application.

FIG. 3 shows a structural view of the dynamic contact 130 and the static contact 120 of the present application. The static contact 120 includes a first welding leg 121 and a static contact point 122; the dynamic contact 130 includes a second welding leg 131 and a dynamic contact point 132; both the second welding leg 131 and the first welding leg 121 protrude beyond the base body 110.

Figure 4:
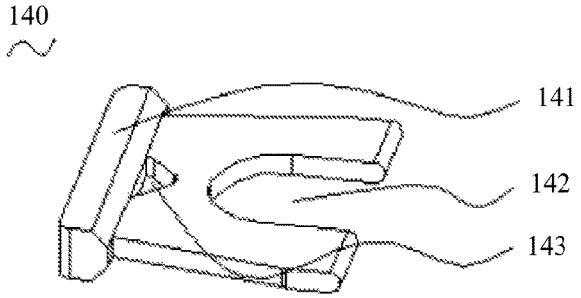
FIG. 4 shows a structural view of the movable plate according to one embodiment of the present application.

FIG. 4 shows a structural view of the movable plate 140 of the present application. The movable plate 140 includes a silencer body 141 arranged on a head of the movable plate 140, a U-shaped groove 142 provided on a rear part of the movable plate 140, and a first slot 143 provided adjacent to the silencer body 141; an end of the movable plate 140 where the silencer body 141 is located is abutted against the dynamic contact 130 and the static contact 120.

Figure 5:
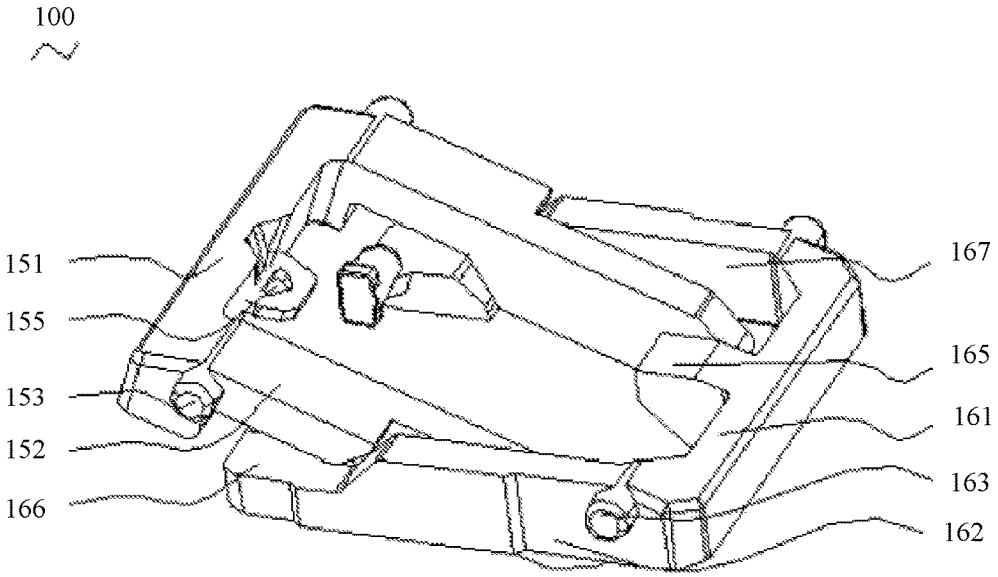
FIG. 5 shows a structural view of the first balancing stand and the second balancing stand according to one embodiment of the present application.

FIG. 5 shows a structural view of the first balancing stand 150 and the second balancing stand 160 of the present application. The first balancing stand 150 and the second balancing stand 160 intersect with each other and are pin jointed together in a superimposed way; a lower end of the first balancing stand 150 and a lower end of the second balancing stand 160 are pin jointed with the two ends of the base body 110 respectively; an upper end of the first balancing stand 150 and an upper end of the second balancing stand 160 are pin jointed with the two ends of the bottom of the keycap 170 respectively. An X-shaped structure is formed by the first balancing stand 150 and the second balancing stand 160; the movable plate 140, the dynamic contact 130, and the static contact 120 are all located between the cross superimposed parts of the first balancing stand 150 and the second balancing stand 160; and an elastic body 180 is arranged between the first balancing stand 150 and the U-shaped groove 142 of the movable plate 140; the silencer body 141 is a soft rubber and the elastic body 180 is a tension spring.

Both the first balancing stand 150 and the second balancing stand 160 are of U shape, in which the first balancing stand 150 includes a first cross bar 151 and two first connecting rods 152. Two ends of the first cross bar 151 protrude outwards to form a first pin jointed shaft 153 which is pin jointed with the keycap 170. The two first connecting rods 152 are parallel to each other and respectively connected with each of two ends of the first cross bar 151. Inner sides of rear ends of the two first connecting rods 152 both protrude to form a second pin jointed shaft 154 which is pin jointed with the base body 110. The second balancing stand 160 includes a second cross bar 161 and two second connecting rods 162. Two ends of the second cross bar 161 protrude outwards to form a third pin jointed shaft 163 which is pin jointed with the keycap 170. The two second connecting rods 162 are parallel to each other and respectively connected with each of two ends of the second cross bar 161. Inner sides of rear ends of the two second connecting rods 162 both protrude to form a fourth pin jointed shaft 164 which is pin jointed with the base body 110. Furthermore, the two second connecting rods 162 are respectively arranged along inner sides of the two first connecting rods 152, while middle parts of the two second connecting rods 162 are respectively pin jointed with middle parts of the two first connecting rods 152; a second slot 155 is provided in one side of the first cross bar 151 facing the second cross bar 161; a bulge 165 is provided on one side of the second cross bar 161 facing the first cross bar 151, in which the second slot 155 is corresponded to the bulge 165. Two ends of the elastic body 180 are respectively hooked up to the first slot 143 of the movable plate 140 and the second slot 155 of the first balancing stand 150 so as to move the movable plate 140.

A first inlay slot 166 is arranged in a rear end of the second connecting bar 162; while a second inlay slot 167 is arranged in an inner side of a front end of the second connecting bar 162. Under superimposed state, a front half section of the first connecting bar 152 is inlayed in the first inlay slot 166, while the rear half section of the first connecting bar 152 is inlayed in the second inlay slot 167.

An external side of a middle section of the first connecting bar 152 protrudes outwards to form a fifth pin jointed shaft 156 correspondingly, the second pin jointed shaft 162 is provided with a pin jointed hole 168. The fifth pin jointed shaft 156 is inserted into the pin jointed hole 168 for pin joint.

Figure 6:
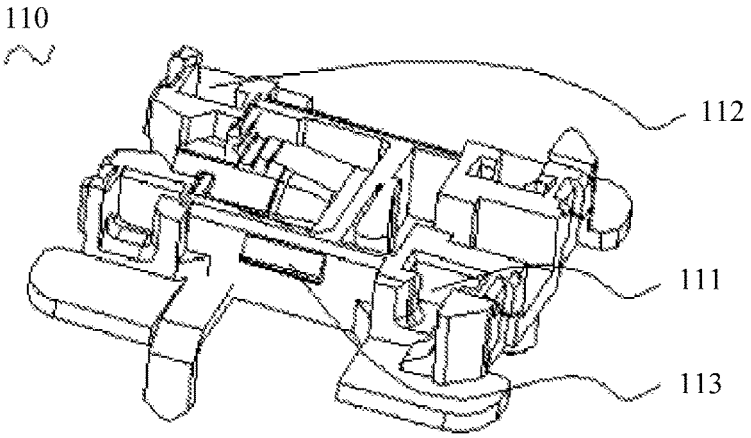
FIG. 6 shows a structural view of the base body according to one embodiment of the present application.

FIG. 6 shows a structural view of the base body 110 of the present application. A first pin jointed slot 111 and a second pin jointed slot 112 are arranged in the base body 110. The second pin jointed shaft 154 and the fourth pin jointed shaft 164 are respectively inlayed in the first pin jointed slot 111 and the second pin jointed slot 112.

Figure 7:
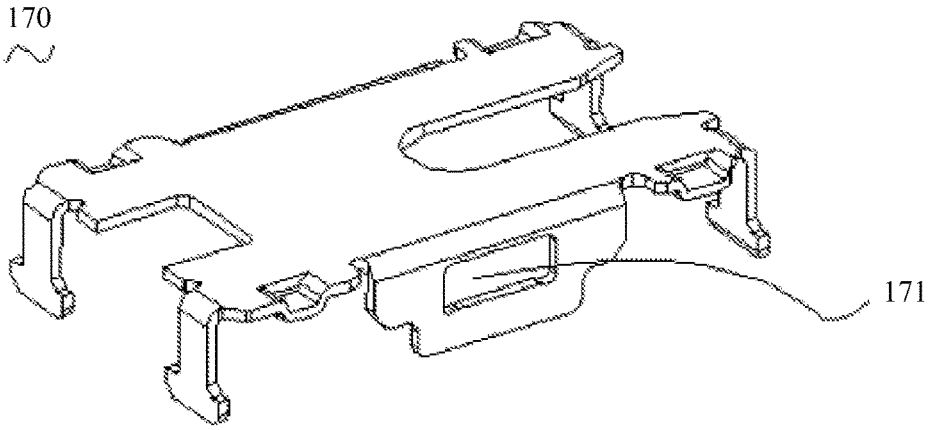
FIG. 7 shows a structural view of the keycap according to one embodiment of the present application.

FIG. 7 is a structural view of the keycap 170 of the present application. A button hole 171 is arranged in the keycap 170; while a button tooth 113 corresponding to the button hole 171 is arranged on the base body 110. The button hole 171 together with the button tooth 113 may make the keycap 170 fitted to the base body 110 detachably.

Advantages of the present application include:

Firstly, the silencer body 141 is arranged on a head of the movable plate 140; therefore, when the movable plate 140 moves upwards and downwards, the first balancing stand 150 and the second balancing stand 160 would be impacted through the silencer body 141 that acts as a buffer, which lower the noise while pressing the switch with a simple and ingenious structure. Secondly, whichever position of the keycap 170 is under force of a finger, the first balancing stand 150 and the second balancing stand 160 are always working in linkage such as to move the movable plate 140, realizing firm downwards press and making the connection between the static contact 120 and the dynamic contact 130 more sensitive; furthermore, no noise will be generated while the connection occurs, further reducing working noise while the key switch 100 is working. Thirdly, by intersecting the first balancing stand 150 with the second balancing stand 160 and pin jointing the first balancing stand 150 with the second balancing stand 160 in a superimposed way, and forming the X-shaped structure using the first balancing stand 150 and the second balancing stand 160 so as to move the movable plate 140 through the elastic body 180, the thickness of the product is reduced substantially compared with traditional guide-rod structure, which is advantageous for miniaturization. Fourthly, the silencer body 141 is a soft rubber which acts as a buffer against impact with excellent silencing effect, which further lowers the noise while the key switch 100 is working and avoids bringing trouble to people's work and life, such that the key switch of the present application is very applicable for occasions in which quietness is required.

Assembling process for the silent key switch is as follows:

Placing the static contact 120 and the dynamic contact 130 in corresponding position of the base body in a top-down process; arranging the movable plate 140 on the left side of the dynamic contact 130 and the static contact 120 such that the silencer body 141 is contacted with the dynamic contact 130 and the static contact 120; intersecting the first balancing stand 150 with the second balancing stand 160 and pin jointing the first balancing stand 150 with the second balancing stand 160, and inlaying the second pin jointed shaft 154 and the fourth pin jointed shaft 164 respectively in the first pin jointed slot 111 and the second pin jointed slot 112 such that the movable plate 140, the dynamic contact 130, and the static contact 120 are all located between the cross superimposed parts of the first balancing stand 150 and the second balancing stand 160; hooking two ends of the elastic body 180 respectively up to the first slot 143 of the movable plate 140 and the second slot 155 of the first balancing stand 150; at last, assembling the keycap 170 to fit the button tooth 113 to the button hole 171.

Figure 8:
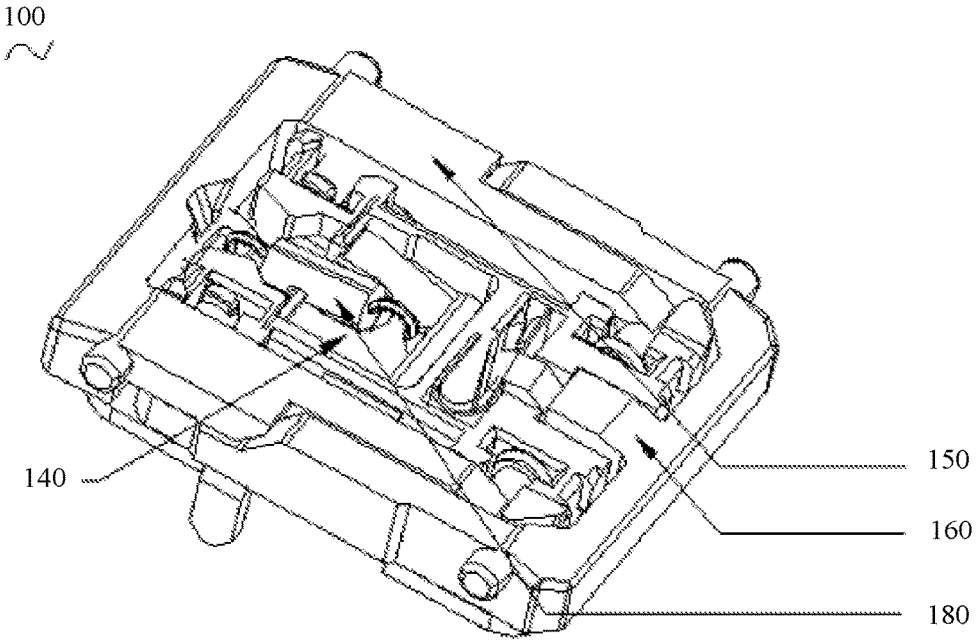
FIG. 8 shows a perspective view of the silent key switch in on condition according to one embodiment of the present application.
Figure 9:
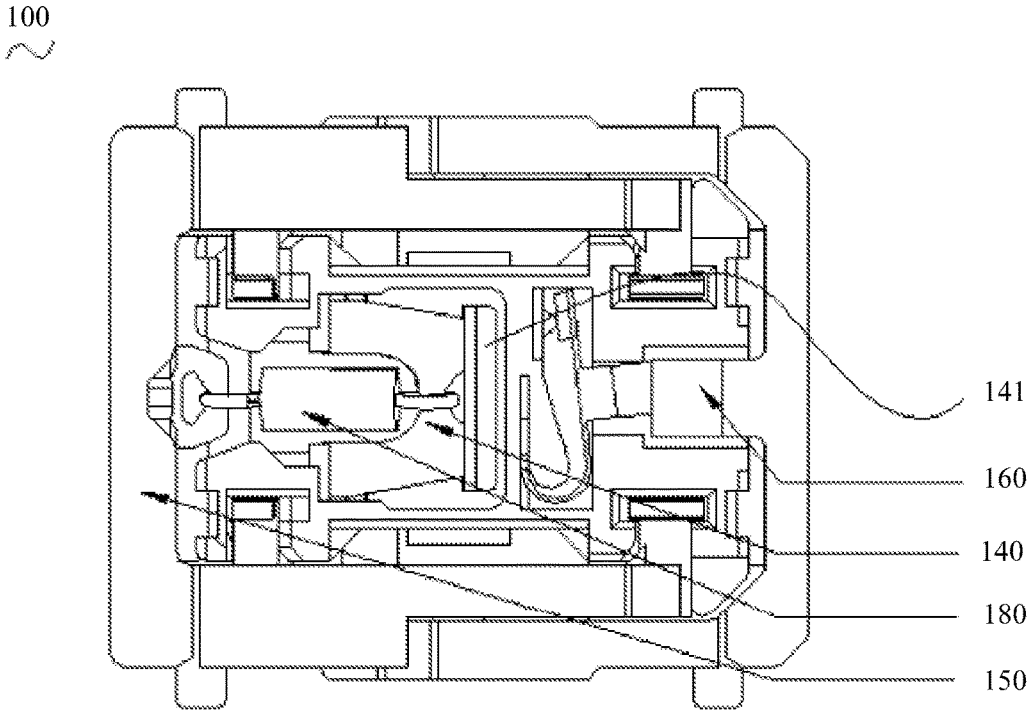
FIG. 9 shows a structural view of the silent key switch in on condition according to one embodiment of the present application.
Figure 10:
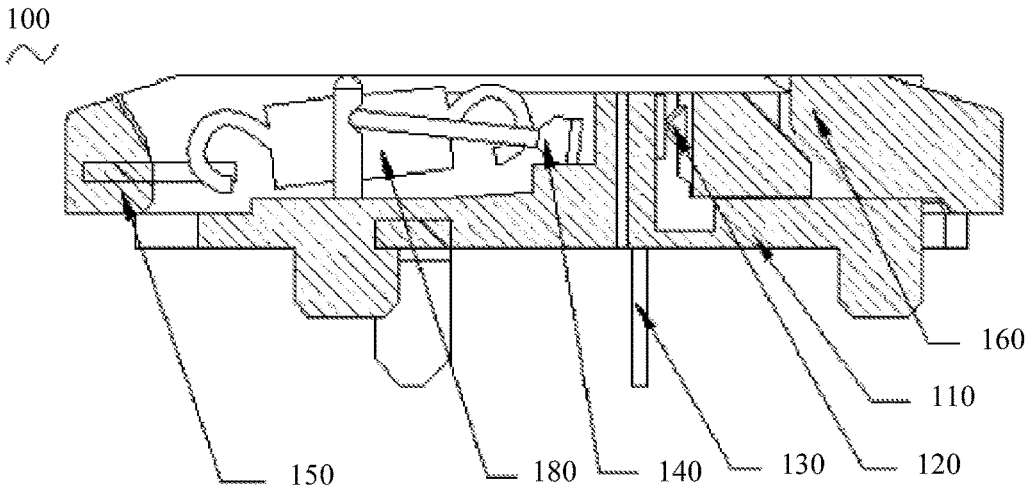
FIG. 10 shows a sectional view of the silent key switch in on condition according to one embodiment of the present application.

Working principles of the present application are as follows:

FIG. 8 through FIG. 10 are respectively sectional, structural and sectional views of the silent key switch in on condition according to embodiments of the present application.

While the keycap 170 is pressed down, the first balancing stand 150 and the second balancing stand 160 are under force and pressed downwards to be compressed together; at the same time, the elastic body 180 is stretched and the movable plate 140 moves rightwards, such that the dynamic contact point 132 is slightly contacted with the static contact point 122 electrically and the key switch is on. In the process, the silencer body 141 made of soft rubber impacts on lower arms of the first balancing stand 150 and the second balancing stand 160 so as to buffer the impact and lower the noise generated while impacting, achieving desirable silencing effect.

Figure 11:
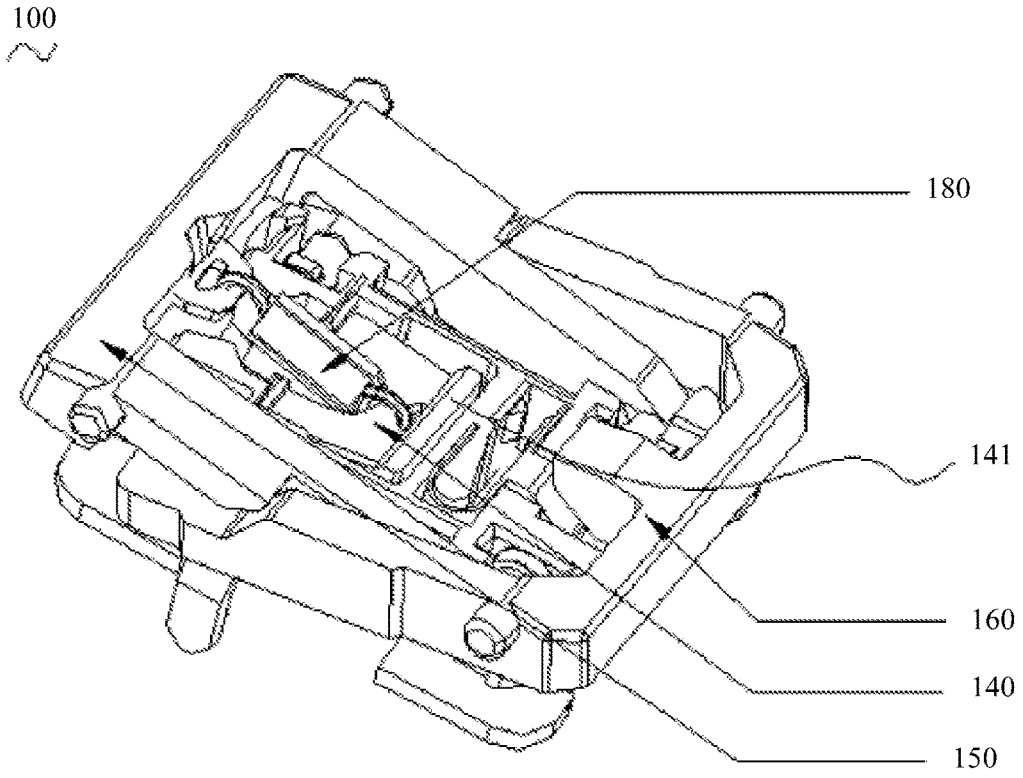
FIG. 11 shows a perspective view of the silent key switch in off condition according to one embodiment of the present application.
Figure 12:
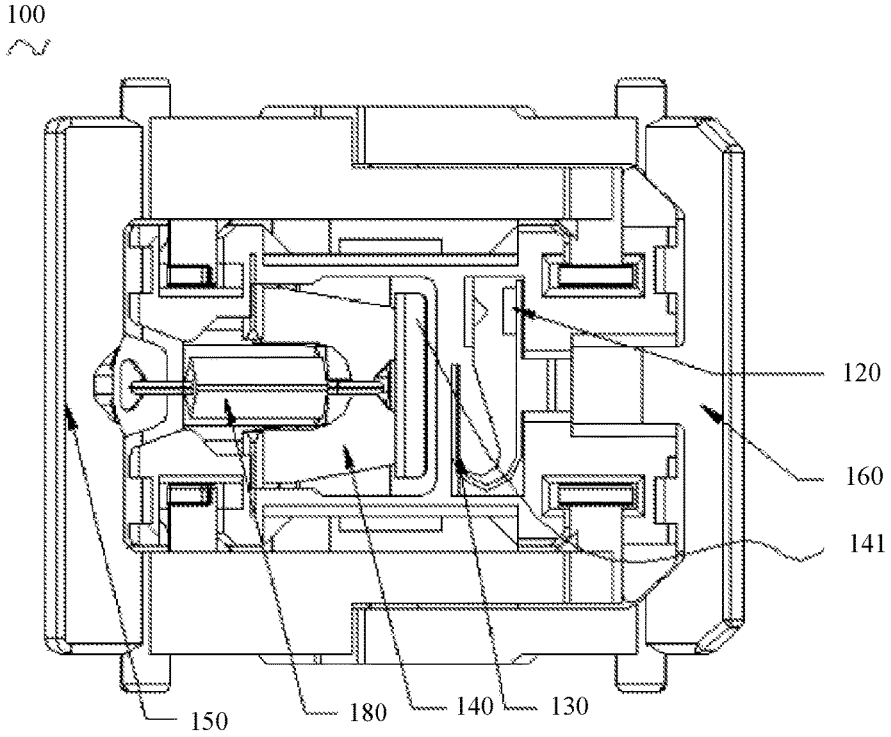
FIG. 12 shows a structural view of the silent key switch in off condition according to one embodiment of the present application.
Figure 13:
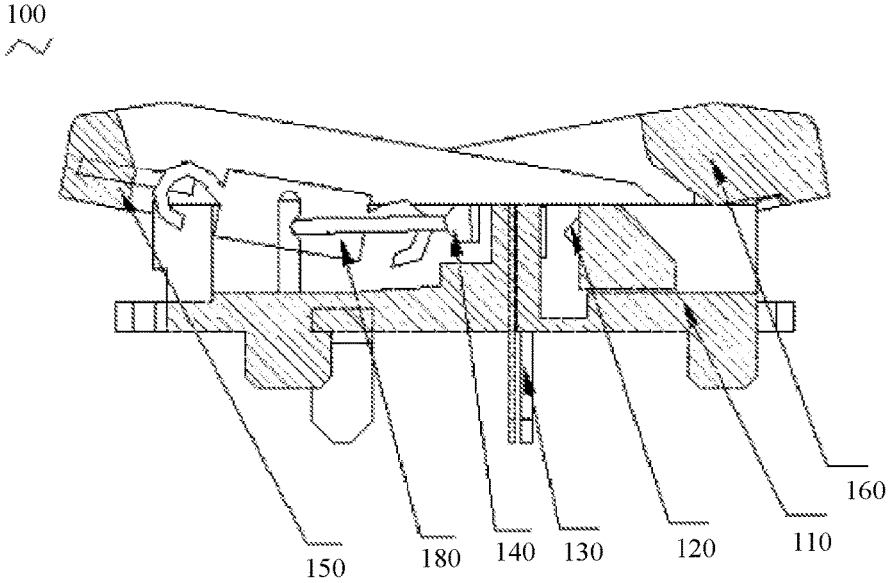
FIG. 13 shows a sectional view of the silent key switch in off condition according to one embodiment of the present application.

FIG. 11 through FIG. 13 are respectively sectional, structural and sectional views of the silent key switch in off condition according to embodiments of the present application.

While the keycap 170 is released, the elastic body 180 returns to its original state. Under the force of the elastic body 180, the first balancing stand 150 and the second balancing stand 160 open up upwards, and the keycap 170 returns upwards. At the same time, the movable plate 140 moves leftwards, such that the dynamic contact point 132 is disconnected with the static contact point 122. In the process, the silencer body 141 made of soft rubber impacts on upper arms of the first balancing stand 150 and the second balancing stand 160 so as to buffer the impact and lower the noise generated while impacting, achieving desirable silencing effect.

The above-described embodiments merely represent several embodiments of the present invention, and the description thereof is more specific and detailed, but it cannot be understood as limiting the scope of the patent of the present invention. It should be noted that, for those skilled in the art, several variations and improvements may be made without departing from the concept of the present invention, and these all fall within the protection scope of the present invention. Therefore, the scope of protection of the present application shall be subject to the appended claims.

What is claimed is:

1. A silent key switch, comprising a base body, a static contact, a dynamic contact, a movable plate, a first balancing stand, a second balancing stand, and a keycap; the static contact and the dynamic contact are separately arranged on the base body, in which the static contact includes a first welding leg and a static contact point, and the dynamic contact includes a second welding leg and a dynamic contact point; both the second welding leg and the first welding leg protrude beyond the base body; the movable plate includes a silencer body arranged on a head of the movable plate, a U-shaped groove provided on a rear part of the movable plate, and a first slot provided adjacent to the silencer body; an end of the movable plate where the silencer body is located is abutted against the dynamic contact and the static contact; the first balancing stand and the second balancing stand intersect with each other and are pin jointed together in a superimposed way; a lower end of the first balancing stand and a lower end of the second balancing stand are pin jointed with the two ends of the base body respectively; an upper end of the first balancing stand and an upper end of the second balancing stand are pin jointed with the two ends of the bottom of the keycap respectively; an X-shaped structure is formed by the first balancing stand and the second balancing stand; the movable plate, the dynamic contact, and the static contact are all located between cross superimposed parts of the first balancing stand and the second balancing stand; and an elastic body is arranged between the first balancing stand and the U-shaped groove of the movable plate; the silencer body is a soft rubber and the elastic body is a tension spring.

2. The silent key switch of claim 1, wherein both the first balancing stand and the second balancing stand are of U shape, in which the first balancing stand includes a first cross bar and two first connecting rods; two ends of the first cross bar protrude outwards to form a first pin jointed shaft which is pin jointed with the keycap; the two first connecting rods are parallel to each other and respectively connected with each of two ends of the first cross bar; inner sides of rear ends of the two first connecting rods both protrude to form a second pin jointed shaft which is pin jointed with the base body; the second balancing stand includes a second cross bar and two second connecting rods; two ends of the second cross bar protrude outwards to form a third pin jointed shaft which is pin jointed with the keycap; the two second connecting rods are parallel to each other and respectively connected with each of two ends of the second cross bar; inner sides of rear ends of the two second connecting rods both protrude to form a fourth pin jointed shaft which is pin jointed with the base body; the two second connecting rods are respectively arranged along inner sides of the two first connecting rods, while middle parts of the two second connecting rods are respectively pin jointed with middle parts of the two first connecting rods; a second slot is provided in one side of the first cross bar facing the second cross bar; a bulge is provided on one side of the second cross bar facing the first cross bar, in which the second slot is corresponded to the bulge; two ends of the elastic body are respectively hooked up to the first slot of the movable plate and the second slot of the first balancing stand so as to move the movable plate.

3. The silent key switch of claim 2, wherein a first inlay slot is arranged in a rear end of each of the two second connecting rods; while a second inlay slot is arranged in an inner side of a front end of each of the two second connecting rods; under superimposed state, a front half section of each of the two first connecting rods is inlayed in the first inlay slots, while the rear half section of each of the two first connecting rods is inlayed in the second inlay slots.

4. The silent key switch of claim 3, wherein an external side of a middle section of each of the two first connecting rods protrudes outwards to form a fifth pin jointed shaft; correspondingly, each of the two second connecting rods is provided with a pin jointed hole; the fifth pin jointed shaft is inserted into the pin jointed holes for pin joint.

5. The silent key switch of claim 4, wherein a first pin jointed slot and a second pin jointed slot are arranged in the base body; the second pin jointed shaft and the fourth pin jointed shaft are respectively inlayed in the first pin jointed slot and the second pin jointed slot.

6. The silent key switch of claim 5, wherein a button hole is arranged in the keycap; while a button tooth corresponding to the button hole is arranged on the base body; the button hole together with the button tooth may make the keycap fitted to the base body detachably.

7. The silent key switch of claim 6, wherein the first balancing stand and the second balancing stand are arranged around a periphery of the base body.

* * * * *